United States Patent [19]

Kulczycki et al.

[11] 3,985,160

[45] Oct. 12, 1976

[54] HEDDLE FOR A WEAVING MACHINE FOR MAKING TRIAXIAL FABRICS

[75] Inventors: Karol Kulczycki, Parsippany, N.J.; Burns Darsie, Rockford, Ill.

[73] Assignee: Barber-Colman Company, Rockford, Ill.

[22] Filed: May 30, 1975

[21] Appl. No.: 582,246

[52] U.S. Cl. ..... 139/93; 139/DIG. 1; 139/11

[51] Int. Cl.[2] ..... D03C 9/02; D03D 41/00

[58] Field of Search ..... 139/93–96, 139/DIG. 1, 11, 12; 66/86 M

[56] References Cited

UNITED STATES PATENTS

| | | | |
|---|---|---|---|
| 550,068 | 11/1895 | Crompton | 139/DIG. 1 |
| 1,368,215 | 2/1921 | Stewart | 139/DIG. 1 |
| 3,066,510 | 12/1962 | Kohl | 66/86 M |
| 3,369,379 | 2/1968 | Shepard | 66/86 M |
| 3,640,314 | 2/1972 | Strauss | 139/93 X |

FOREIGN PATENTS OR APPLICATIONS

| | | | |
|---|---|---|---|
| 1,111,398 | 10/1955 | France | 139/12 |
| 484,092 | 8/1953 | Italy | 139/11 |

*Primary Examiner*—James Kee Chi

*Attorney, Agent, or Firm*—Bell, Seltzer, Park & Gibson

[57] ABSTRACT

A heddle for a weaving machine for making triazial fabrics is adapted to be moved longitudinally during a warp shed forming operation and also is adapted to be shifted weftwise of the weaving machine. The heddle is characterized by having a nose portion with a warp strand guide opening extending therethrough, with means on the heddle adapted to be engaged for imparting longitudinal movement thereto, and other means thereon adapted to be engaged for shifting the heddle weftwise of the weaving machine.

11 Claims, 4 Drawing Figures

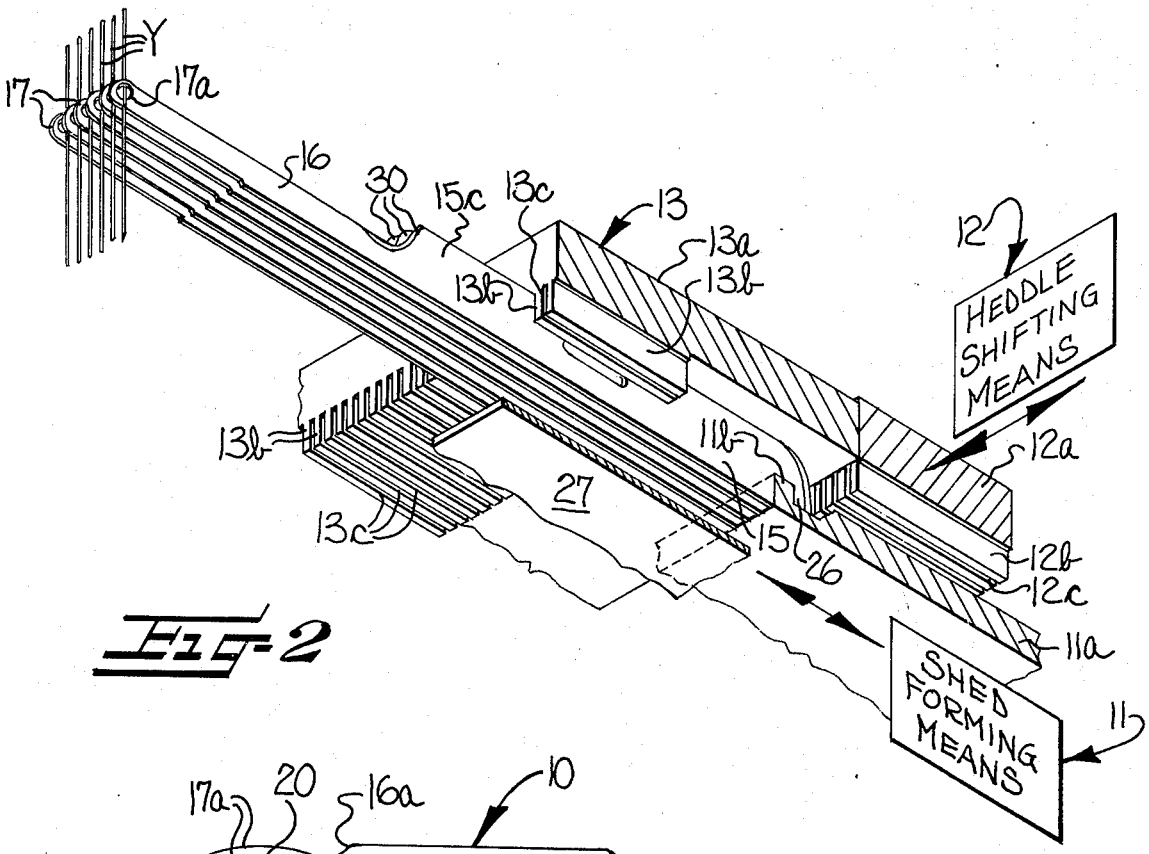
Fig-2
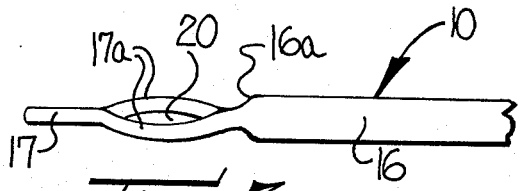
Fig-3
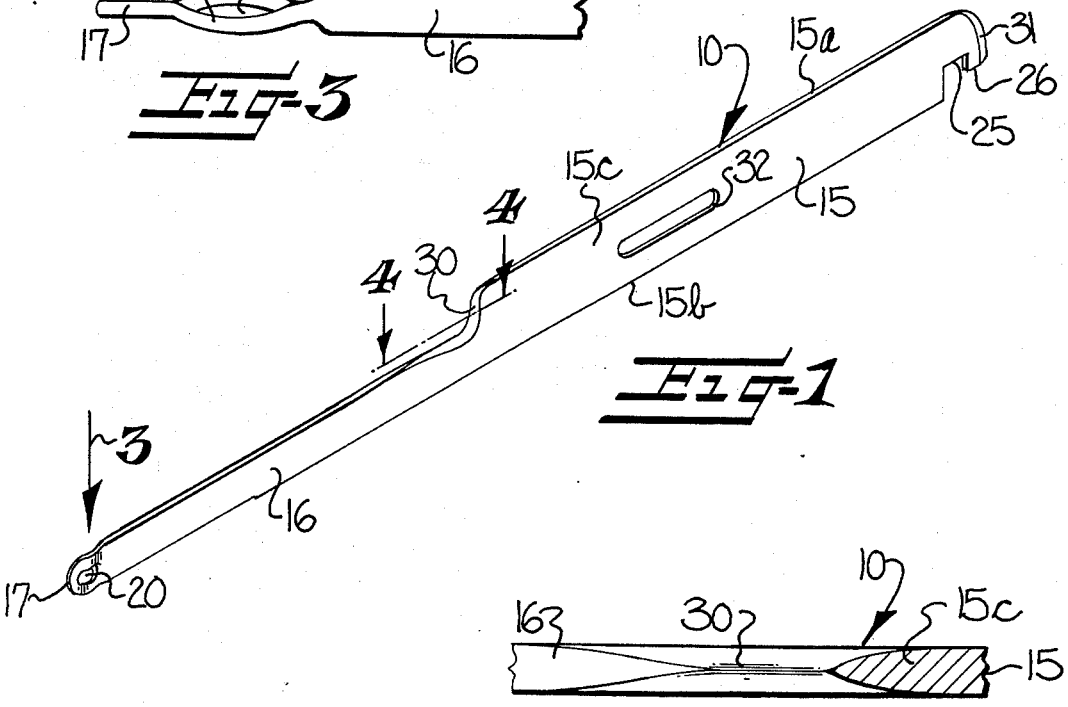
Fig-1
Fig-4

HEDDLE FOR A WEAVING MACHINE FOR MAKING TRIAXIAL FABRICS

This invention relates to weaving machines, and more especially, to an improved heddle for a machine for weaving so-called triaxial fabrics such as are disclosed, for example, in Norris F. Dow's Reissued U.S. Pat. No. 28,155; originally U.S. Pat. No. 3,446,251.

Triaxial fabrics are generally characterized by including at least two sets of warps interwoven with wefts and wherein one of the sets of warps crosses the other set and both sets of warps extend diagonally of the length of the fabric. In the prior art of weaving triaxial fabrics, such as disclosed in Crompton's U.S. Pat. No. 550,068 and Stewart's U.S. Pat. No. 1,368,215, for example, heddles are arranged so as to be moved longitudinally for forming successive sheds of the warps extending through the heddles, and in which sheds the wefts are inserted, and the heddles also are arranged so as to be shifted weftwise following certain shed forming operations thereof so as to cause the respective warps to extend diagonally of the fabric being woven.

It is an object of this invention to provide an improved heddle for a weaving machine for making triaxial fabrics, which heddle is adapted to be readily manipulated by automatic means for effecting the shed forming operations thereof as well as the weftwise shifting movements thereof during the weaving of triaxial fabrics.

It is a more specific object of this invention to provide a heddle of the type described having a nose portion with a warp strand guide opening extending therethrough, and wherein the heddle has means thereon adapted to be engaged for imparting longitudinal movement thereto, with at least a medial portion of the heddle having a shoulder portion thereon adapted to be engaged for shifting the heddle weftwise of the weaving machine.

It is still another more specific object of this invention to provide a heddle of the type described which is an elongate strip material and includes a body portion of a predetermined width with an elongate reduced width frontal portion extending forwardly from the body portion and terminating in a nose portion having a warp strand guide opening extending therethrough. A rear portion of the heddle has a hook-shaped projection formed integral with the body portion and extending rearwardly thereof and adapted to be engaged for imparting longitudinal movement to the heddle, and the body portion also has a shoulder portion extending along one edge thereof and adapted to be engaged for shifting the heddle weftwise of the weaving machine.

Some of the objects of the invention having been stated, other objects will appear as the description proceeds when taken in connection with the accompanying drawings, in which —

FIG. 1 is a perspective view of the preferred embodiment of the heddle of the present invention;

FIG. 2 is a schematic perspective view showing a few of the heddles of the present invention in association with suitable warp shed forming means and heddle shifting means for moving the heddles longitudinally during warp shed forming operations and for shifting the heddles weftwise of the weaving machine between certain shed forming operations;

FIG. 3 is an enlarged fragmentary view of the free front end or nose portion of the heddle looking substantially in the direction of the arrow indicated at 3 in FIG. 1; and FIG. 4 is an enlarged fragmentary sectional view taken substantially along line 4—4 in FIG. 1.

Referring more specifically to the drawings, the improved heddle, broadly designated at 10, is particularly devised for use with a machine for weaving fabric of a type having wefts extending transversely of the length of the fabric and including at least one set of warps extending diagonally of the fabric and crossing at least one other set of the warps which also extends diagonally of the fabric. Such fabrics are sometimes referred to as "triaxial" fabrics and, consequently, the machine with which the heddle 10 is adapted to be associated will be referred to herein as a "triaxial weaving machine". As shown schematically in FIG. 2, the triaxial weaving machine may include a warp shed forming means 11 for moving a weftwise row of the heddles longitudinally during warp shed forming operations, and heddle shifting means 12 for shifting the heddles weftwise of the weaving machine for shifting respective warps Y diagonally of the fabric being woven. For the purpose of this disclosure only a few heddles 10 of a weftwise row are shown in FIG. 2. These heddles are arranged to cooperate with a similar opposing row of heddles, not shown, for repeatedly forming warp sheds of the warps Y extending through the heddles to the fell of the fabric being woven.

The weaving machine is also provided with suitable heddle guide means 13 cooperating with the heddle shifting means 12 for guiding the respective row of heddles forwardly and rearwardly between a retracted position and an extended position as effected by shed forming means 11. It should be noted that the warp shed may be open when the heddles occupy either the fully retracted position or the illustrated fully extended position, although the warps Y are positioned adjacent one side of the plane of the fell of the fabric when the heddles occupy one of the open-shed positions, and the warps Y are crossed and positioned adjacent the other side of the plane of the fell of the fabric when the heddles occupy the other open-shed position. The warp shed forming means 11 may include a weftwise extending heddle shedding bar 11*a* which is also shown occupying an extended open-shed position in FIG. 2. Bar 11*a* is movable forwardly and rearwardly and has an elongate weftwise extending projection or rib 11*b* thereon adapted to be engaged by each of the heddles 10 in the respective row in a manner to be later explained.

Heddle shedding bar 11*a* may underlie heddle shifting means 12, which is shown as comprising an elongate weftwise extending and weftwise movable heddle indexing or heddle shifting member or bar 12*a* provided with a weftwise row of closely spaced forwardly and rearwardly extending teeth or wall members 12*b* shown projecting downwardly from bar 12*a* toward the shedding bar 11*a*. The teeth 12*b* are spaced apart from each other to define passageways or slots 12*c* therebetween adapted to slidably receive therein shoulder portions of respective heddles 10, as will be later described, preparatory to indexing or shifting the heddles weftwise of the weaving machine. Thus, the heddle shifting bar 12*a* also serves as a movable heddle guiding member. It should be noted that the distance between the centers of adjacent passageways 12*c* in heddle shifting bar 12*a* determines the distance between the centers of adjacent warps Y in the triaxial fabric to be woven. Thus, in order to weave a dense triaxial fabric, it is apparent that it is preferred that the passageways 12*c* be quite close together and that the heddles be of relatively thin material so as to be properly guided in the passageways 12*c* during shed forming operations.

The heddle guide means 13 may take the form of an elongate weftwise extending guide member or bar 13*a* which may be stationarily mounted. Bar 13*a* is provided with a plurality of teeth or wall members 13*b* thereon shown projecting downwardly therefrom and spaced forwardly of the respective teeth 12*b* of heddle shifting bar 12*a*. The teeth 13*b* of heddle guide bar 13*a* define passageways or slots 13*c* therebetween which extend forwardly and rearwardly and are necessarily disposed in substantial alignment with the passageways 12*c* of heddle shifting means 12 during any concurrent engagement of any of the heddles 10 of FIG. 2 with passageways 12*c*, 13*c* in both bars 12*a*, 13*a*.

The heddle shifting means 12 may include suitable means, not shown, for imparting an active weftwise shifting movement or stroke to heddle shifting bar 12*a* in one weftwise direction and relative to guide bar 13*a* for a distance about equal to an integral multiple of the distance between the centers of adjacent passageways 12*c* following each of, or certain of, the rearward movements of shedding bar 11*a* and heddles 10 from the fully extended position shown in FIG. 2 to the fully retracted position, according to the desired pattern. Suitable heddle transfer means, not shown, may be provided for transferring each successive heddle from the leading end of the illustrated row of heddles to the trailing end of the aforementioned similar opposing row of heddles, not shown, following each active weftwise shifting stroke of bar 12*a*. Similarly, since such opposing row of heddles may be shifted in the opposite weftwise direction from the illustrated row of FIG. 2, successive leading heddles may be transferred from the opposing row of heddles to the trailing end of the illustrated row. Following each active shifting movement of heddle shifting bar 12*a* and upon subsequent forward movement of shedding bar 11*a* and heddles 10 to the extended position shown in FIG. 2, an inactive stroke may be imparted to heddle shifting bar 12*a*, in the opposite weftwise direction, to return the same to its original position.

It is apparent that the heddles 10 of FIG. 2 must be positioned out of engagement with the stationary guide bar 13*a* during any weftwise shifting movement of the heddles effected by engagement of the heddles 10 with the passageways 12*c* of heddle shifting bar 12*a* during an active stroke of bar 12*a*. Conversely, it is apparent that the heddles 10 of FIG. 2 must occupy a fully extended position, or are in the course of a forward movement thereof approaching the fully extended position, whenever an inactive weftwise movement is being imparted to heddle shifting bar 12*a* to return the same to its original position. In other words, the heddles 10 of FIG. 2 are in slidable engagement with stationary guide bar 13*a* and must, therefore, be out of engagement with shifting bar 12*a* during each inactive stroke of bar 12*a*.

Since the means for moving the heddles 10 forwardly and rearwardly, the heddle shifting means 12, the heddle guide means 13 and the heddle transfer means, not shown, are disclosed herein as a schematic illustrative environment for the improved heddle and do not constitute elements of the invention being claimed herein, a further more detailed description thereof is deemed unnecessary.

Each heddle is of elongate form and may be formed of any suitable material which will not be adversely affected by changes in temperature and/or humidity of the ambient air in a weave room. For example, the heddle may be formed of plastic or any suitable metal, but it is preferred that the heddle be formed of stainless steel strip material.

As a non-limiting example, and depending upon how close together the warps must be to obtain the desired density of the triaxial fabric to be woven, the heddle 10 may be in the range of about 0.015 to 0.032 inch thick (0.38 to 0.81 millimeters). It is apparent that the length and width of the heddle 10 should be suited to the environmental structure of the triaxial weaving machine. Thus, by way of illustration only, in heddles adapted for use in a particular weaving machine constructed to include shed forming means, heddle shifting means and heddle guide means of substantially the type heretofore described and shown in FIG. 2, it was determined that, desirably, the overall length of each heddle may be in the range of about 3.75 to 5 inches (95 to 127 millimeters) and at least the major portion of the heddle body portion, to be presently described, may be of a width in the range of about ⅜ to ½ inch (9.525 to 12.70 millimeters).

Each heddle 10 comprises an elongate body portion 15 of a predetermined width, and an elongate, narrow, reduced width frontal portion 16 which extends forwardly from and is integral with body portion 15. The reduced width frontal portion 16 may be about one-half as wide as body portion 15 and terminates in a nose portion 17 which is also narrow with respect to body portion 15 and has a rounded or substantially semicircularly-shaped free end which defines the front end of the heddle 10. The nose portion 17 has a strand guide opening or eye 20 extending therethrough for the respective warp Y and, since the respective warp Y may take the form of a textile yarn and passes alongside the nose portion 17 in its course through the strand guide opening 20 during weaving, it will be observed in FIG. 3 that the nose portion 17 is at least partially offset, as at 17*a*, on respective opposite sides of the guide opening 20 so as to avoid abrading the warp Y passing through the strand guide opening 20.

Since the nose portion 17 of each heddle 10 is at least partially offset on respective opposite sides thereof, it is preferred that the distance between the outer surfaces of such offset portions 17*a*, measured weftwise of nose portion 17, is no more than about the same as the thickness of the body portion 15 of heddle 10. Therefore, as best shown in FIG. 3, the elongate frontal portion 16 of the heddle 10 may be tapered, as at 16*a*, toward the free end of the nose portion 17 so that the portion of the length of strip material defining the nose portion 17 is of substantially less thickness than at least the major portion of the remainder of the length of the heddle 10.

It will be observed in FIG. 1 that the elongate body portion 15 of heddle 10 has opposing, substantially parallel, first and second longitudinal edges 15*a*, 15*b* thereon. Since at least a medial portion of the heddle, represented by body portion 15, is broad relative to frontal portion 16 and nose portion 17, the reduced width frontal portion 16 of heddle 10 is offset from the first longitudinal edge 15*a* toward the second longitudinal edge 15*b* of body portion 15, and the first longitudinal edge 15*a* thus defines a projecting shoulder portion 15*c* on at least a medial portion of the heddle and extending along one edge thereof. It is preferred that the edge of the reduced width frontal portion 16 facing away from shoulder portion 15*c*; i.e., the bottom edge of frontal portion 16 in FIGS. 1 and 2, is substantially coextensive with the second longitudinal edge 15*b* of body portion 15. As will be later explained, shoulder portion 15*c* represents a preferred embodiment of means on the heddle adapted to be engaged for shifting the heddle weftwise of the weaving machine.

The heddle also is provided with means adapted to be engaged for imparting longitudinal movement thereto. To this end, the rear portion of each heddle 10 has a cutout 25 therein adapted to be engaged by the elongate rib 11b of shed forming means 11, for example, for imparting longitudinal or shedding movements to heddle 10. A hook-shaped projection 26 is integral with and extends rearwardly of body portion 15 to define the tail of the heddle. As preferred, the hook-shaped projection 26 partially defines the cutout 25 and terminates short of the plane of the adjacent second longitudinal edge 15*b* of the body portion 15 of heddle 10 so that, when cutout 25 and projection 26 are properly engaged by shedding bar 11*a*, as shown in FIG. 2, both the shedding bar 11*a* and the longitudinal edge 15*b* of each heddle body portion 15 may be positioned in sliding engagement with a suitable planar guide surface as represented by the stationary guide plate 27 shown in FIG. 2. In this regard, it will be observed in the right-hand portion of FIG. 2 that the hook-shaped projection 26 is adapted to be engaged by rib 11*b* of shed forming means 11 for imparting longitudinal shedding movements to heddle 10. Also, it is apparent that the cutout 25 and hook-shaped projection 26 of each heddle 10 may readily be moved weftwise along the rib 11*b* of shedding bar 11a anytime the heddles are being shifted weftwise by heddle shifting bar 12*a* in FIG. 2. Although it is preferred that the cutout 25 and projection 26 are shaped and positioned as described above, it is to be understood that the shape and position of cutout 25 and projection 26 may be different from that described so as to accord with variations in the environmental shed forming means of the weaving machine.

As shown in FIG. 2, and as is preferred, the distance between the upper surface of stationary guide plate 27 and those surfaces of the bars 12*a*, 13*a* from which the respective teeth or wall members 12*b*, 13*b* project, and which define bridging end walls of the heddle guiding passageways 12*c*, 13*c*, may be only slightly greater than the width of the body portions 15 of the heddles 10. Thus, the first longitudinal edges, or the upper edges 15*a* of the heddle body portions 15 as viewed in FIG. 2, may be moved in sliding engagement with the heddle guiding passageways 12*c*, 13*c* and the heddles 10 may be slidably supported for movement by their edges 15*b* resting upon the upper surface of stationary guide plate 27, as viewed in FIG. 2.

Since it is preferred that the longitudinal edges 15*a*, 15*b* of each heddle 10 are substantially parallel, the heddles 10 may be properly guidingly engaged while occupying any desired inclined, horizontal or vertical position. For example, the structure shown in FIG. 2 could be arranged so that the heddle shedding bar 11*a*, the heddle shifting bar 12*a*, the heddle guide bar 13*a* and heddles 10 are inverted and positioned beneath the stationary guide plate 27. With such an inverted arrangement, it is apparent that the teeth 12*b*, 13*b* then would extend upwardly from the heddle shifting bar 12*a* and heddle guide bar 13*a* respectively, and that the heddles 10 then would be slidably supported for movement by the first longitudinal edges 15*a* thereof resting upon the aforementioned bridging wall portions of the passageways 12*c*, 13*c*. It is thus seen that, as preferred, the edges 15*a*, 15*b* of body portion 15 of each heddle 10 serve as opposing, spaced apart, substantially parallel longitudinal edges for the heddle 10 so that the heddle may be selectively positioned to be slidably supported for movement by either of the longitudinal edges resting upon a supporting surface.

As indicated above, the shoulder portions 15*c* of the heddles engage the passageways 12*c*, 13*c* in both respective bars 12*a*, 13*a*. It is to be noted, however, that the length of the shoulder portion 15*c* of each heddle 10 is such with respect to the length of the teeth 12*b*, 13*b* of bars 12*a*, 13*a*, and with respect to the distance from teeth 12*b* to teeth 13*b*, that the shoulder portions 15*c* are adapted to be moved out of engagement with the teeth 13*b* of stationary heddle guide bar 13*a* and into engagement with the teeth 12*b* of heddle shifting bar 12*a* during each outward movement of heddles 10 by shedding bar 11*a* from the extended position shown to the fully retracted position. Thus, the heddle shoulder portions 15*c* are then positioned so as to permit heddle shifting bar 12*a* to shift the heddles 10 weftwise of the weaving machine relative to stationary heddle guide bar 13*a*.

It is also to be noted that, because the frontal portions 16 of the heddles 10 are of reduced width relative to the body portions 15 and also are offset from the first longitudinal edges 15*a* of the heddles and toward the second longitudinal edges 15*b*, the elongate frontal portions 16 are spaced from the teeth 13*b* as the shoulder portions 15*c* of the heddle body portions 15 are withdrawing from passageways 13c and entering passageways 12*c*. In other words, the reduced width frontal portions 16 of heddles 10 are positioned between stationary plate 27 and stationary heddle guide bar 13*a* and they are out of engagement with teeth 13*b* whenever heddles 10 occupy the fully retracted open-shed position.

Of course, whenever heddles 10 occupy the fully retracted position, the nose portions 17 thereof are located inwardly or forwardly, to the left of stationary guide bar 13*a* and guide plate 27 in FIG. 2, so as to avoid rupturing the warps Y by engagement thereof with stationary guide bar 13*a* and/or plate 27. Even though the heddles 10 occupy the latter position during each weftwise shifting movement thereof, it can be appreciated that the reduced width frontal portions 16 of the heddles 10 then are clear of bar 13*a* so as to provide clearance for the heddles and to permit weftwise shifting of the heddles 10 past the guiding passageways 13*c* by heddle shifting bar 12*a*.

However, before the heddle shifting bar 12*a* subsequently reverses its direction of movement and returns to its original position as is desirable, the heddles 10 in FIG. 2 may be moved inwardly to move the shoulder portions 15*c* thereof out of engagement with heddle shifting bar 12*a* as the rib 11*b* on shedding bar 11*a* engages and pushes forwardly against the rear surface of the body 15 of each heddle, which rear surface is defined by the cutout 25. Thus, bar 11*a* moves the heddles 10 to the fully extended position shown in FIG. 2. It is apparent that the shoulder portions 15*c* of the heddles 10 are moved into sliding engagement with and along the passageways 13*c* in heddle guide bar 13a as the rear ends of the heddles 10 are moved entirely out of engagement with heddle shifting bar 12*a*. There-upon, heddle shifting bar 12*a* may return to its original position, as heretofore indicated, and during which the heddles 10 are being maintained in the desired spaced relationship by heddle guide bar 13*a*. The operation is effected repeatedly so that the heddles may be progressively shifted weftwise of the weaving machine to cause the warps Y to extend diagonally of the fabric being woven.

To aid in guiding the shoulder portion 15*c* of each heddle 10 into the respective guiding passageway 13*c* of guide bar 13*a* during each forward movement of each heddle from the retracted position to the extended position, it is preferred that each projecting shoulder portion 15*c* is provided with a reduced thickness front edge 30, as by being beveled or rounded at its juncture with the reduced width frontal portion 16 of heddle 10. Additionally, it is preferred that the body portion 15 is provided with a reduced thickness rear end edge 31 thereon, as by being beveled or rounded, to aid in guiding the heddle shoulder portion 15*c* into a respective one of the guiding passageways 12*c* of heddle shifting bar 12*a* during longitudinal movement of the respective heddle 10 in the rearward direction; i.e., from left to right in FIG. 2. To aid further in guiding the shoulder portion 15*c* of each heddle 10 into the guiding passageways 12*c*, 13*c* of the respective bars 12*a*, 13*a*, it is preferred that the reduced thickness edges 30, 31 also are convergently inclined with respect to the first longitudinal edge 15*a* of the heddle, with the front edge 30 of shoulder portion 15*c* being generally inclined rearwardly from the adjacent longitudinal edge of frontal portion 16, and with the rear edge 31 of body portion 15 being generally inclined forwardly from the outer surface of the hook-shaped projection 26.

By referring to FIG. 2, it can be seen that, by temporarily positioning heddle shedding bar 11a rearwardly of heddle shifting bar 12*a*, the heddles 10 may be readily positioned with the cutouts 25 and hook-shaped projections 26 in engagement with the rib 11*b* of the bar 11*a* of the warp shed forming means 11. Thereafter, by moving the shedding bar 11*a* forwardly, the shoulder portions 15*c* of the heddles 10 may be readily aligned with and moved into the passageways 12*c*, 13*c* of heddle shifting means 12 and heddle guide means 13, respectively, in setting up the machine for weaving triaxial fabrics. If desired, each heddle 10 may be provided with a suitable opening therethrough, such as an elongate slot 32 extending transversely through body portion 15, for aiding in properly locating and/or anchoring the heddles 10 in the course of manufacture of the heddles.

It is thus seen that there is provided an improved heddle for a weaving machine for making triaxial fabrics which heddle is adapted to be moved longitudinally during warp shed forming operations and is also adapted to be shifted weftwise, and wherein the heddle has a frontal portion or nose portion with a warp strand guide opening extending therethrough and also has means thereon adapted to be engaged for imparting longitudinal movement thereto. Also, it can be seen that the heddle has means thereon adapted to be engaged for shifting the heddle weftwise of the triaxial weaving machine.

In the drawings and specification there has been set forth a preferred embodiment of the invention and, although specific terms are employed, they are used in a generic and descriptive sense only, and not for purposes of limitation.

That which is claimed is:

1. An elongate, flat and thin heddle for a weaving machine for making triaxial fabrics wherein the heddle is adapted to be moved longitudinally during a warp shed forming operation and also is adapted to be shifted weftwise of the weaving machine, said heddle being an elongate strip material and having a nose portion with a warp strand guide opening extending therethrough, said nose portion being of a lesser thickness than at least the major portion of the heddle, said heddle having means thereon adapted to be engaged for imparting longitudinal movement thereto, and at least a medial portion of said heddle having a shoulder portion extending along one edge thereof and adapted to be engaged for shifting the heddle weftwise of the weaving machine.

2. A heddle according to claim 1 having another edge extending longitudinally thereof in opposing, spaced apart and substantially parallel relation to said one edge so that the heddle may be selectively positioned to be slidably supported for movement by either of said edges resting upon a supporting surface.

3. A heddle according to claim 1 provided with a cutout therein serving as said means on the heddle adapted to be engaged for imparting longitudinal movement thereto.

4. A heddle according to claim 1 having a rear portion provided with a hook-shaped projection thereon remote from said nose portion and serving as said means on the heddle adapted to be engaged for imparting longitudinal movement thereto.

5. A heddle according to claim 1 including an elongate reduced width frontal portion extending forwardly from said shoulder portion and having said nose portion on its front end, and said reduced width frontal portion being adapted to provide clearance for the heddle so as to permit the weftwise shifting of the heddle past a heddle guiding passageway.

6. An elongate, flat and thin heddle for a weaving machine for making triaxial fabrics wherein the heddle is adapted to be moved longitudinally during a warp shed forming operation and is also adapted to be shifted weftwise of the weaving machine, said heddle being an elongate strip material and having a body portion of a predetermined width with an elongate reduced width frontal portion terminating in a nose portion having a rounded free end with a warp strand guide opening extending therethrough, said nose portion being of substantially lesser thickness than at least the major portion of the frontal portion, said heddle also including a rear portion having a hook-shaped projection formed integral with said body portion and extending rearwardly thereof and defining the tail of the heddle adapted to be engaged for imparting longitudinal movement to the heddle, and said body portion having a shoulder portion extending along one edge thereof and adapted to be engaged for shifting the heddle weftwise of the weaving machine.

7. A heddle according to claim 6 wherein said body portion has another edge extending longitudinally thereof in opposing, spaced apart and substantially parallel relation to said one edge so that the heddle may be selectively positioned to be slidably supported for movement by either of said edges resting upon a supporting surface.

8. An elongate, flat and thin heddle for a weaving machine for making triaxial fabrics wherein the heddle is adapted to be moved longitudinally during a warp shed forming operation and also is adapted to be shifted weftwise of the weaving machine, said heddle being an elongate strip material and having a nose portion with a warp strand guide opening extending therethrough, said nose portion being of lesser thickness than at least the major portion of the heddle and being at least partially offset on respective sides of the warp strand guide opening to avoid abrading a warp strand passing alongside the nose portion and through the guide opening during weaving, said heddle having means thereon adapted to be engaged for imparting longitudinal movement thereto, and at least a medial portion of said heddle having a shoulder portion extending alone one edge thereof and adapted to be engaged for shifting the heddle weftwise of the weaving machine.

9. A heddle for a weaving machine for making triaxial fabrics wherein the heddle is adapted to be moved longitudinally relative to heddle guiding passageways during a warp shed forming operation and is also adapted to be shifted weftwise of the weaving machine from one heddle guiding passageway to another, said heddle being an elongate strip material and comprising an elongate body portion of a predetermined width having opposing first and second longitudinal edges thereon, an elongate reduced width frontal portion projecting from a front end of said body portion and terminating in a free front end portion having a weft strand guide opening extending therethrough, said reduced width frontal portion being offset from said first longitudinal edge of said body portion and toward said second longitudinal edge so as to define a projecting shoulder portion extending along said first longitudinal edge and adapted to be engaged for shifting the heddle weftwise of the weaving machine, said shoulder portion being provided with a reduced thickness front edge to aid in guiding the shoulder portion forwardly into a heddle guiding passageway and said body portion being provided with a reduced thickness rear end edge thereon to aid in guiding the body portion rearwardly into a heddle guiding passageway, and said body portion having means thereon adapted to be engaged for imparting longitudinal movement to the heddle.

10. A heddle for a weaving machine for making triaxial fabrics wherein the heddle is adapted to be moved longitudinally relative to heddle guding passageways during a warp shed forming operation and is also adapted to be shifted weftwise of the weaving machine from one heddle guiding passageway to another, said heddle being an elongate strip material and comprising an elongate body portion of a predetermined width having opposing first and second longitudinal edges thereon, an elongate reduced width frontal portion projecting from a front end of said body portion and terminating in a free front end portion having a weft strand guide opening extending therethrough, said reduced width frontal portion being offset from said first longitudinal edge of said body portion and toward said second longitudinal edge so as to define a projecting shoulder portion extending along said first longitudinal edge and adapted to be engaged for shifting the heddle weftwise of the weaving machine, said shoulder portion being provided with a reduced thickness front edge to aid in guiding the shoulder portion forwardly into a heddle guiding passageway, and said body portion having means thereon adapted to be engaged for imparting longitudinal movement to the heddle.

11. A heddle for a weaving machine for making triaxial fabrics wherein the heddle is adapted to be moved longitudinally relative to heddle guiding passageways during a warp shed forming operation and is also adapted to be shifted weftwise of the weaving machine from one heddle guiding passageway to another, said heddle being an elongate strip material and comprising an elongate body portion of a predetermined width having opposing first and second longitudinal edges thereon, an elongate reduced width frontal portion projecting from a front end of said body portion and terminating in a free front end portion having a weft strand guide opening extending therethrough, said reduced width frontal portion being offset from said first longitudinal edge of said body portion and toward said second longitudinal edge so as to define a projecting shoulder portion extending along said first longitudinal edge and adapted to be engaged for shifting the heddle weftwise of the weaving machine, said body portion being provided with a reduced thickness rear end edge thereon to aid in guiding the body portion rearwardly into a heddle guiding passageway, and said body portion having means thereon adapted to be engaged for imparting longitudinal movement to the heddle.

* * * * *